US006773360B2

(12) United States Patent
Willett et al.

(10) Patent No.: US 6,773,360 B2
(45) Date of Patent: Aug. 10, 2004

(54) GOLF CLUB HEAD HAVING A REMOVABLE WEIGHT

(75) Inventors: Kraig A. Willett, Fallbrook, CA (US); Joseph H. Hoffman, Carlsbad, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 4 days.

(21) Appl. No.: 10/290,817

(22) Filed: Nov. 8, 2002

(65) Prior Publication Data

US 2004/0092332 A1 May 13, 2004

(51) Int. Cl.[7] ..... A63B 53/04; A63B 53/06

(52) U.S. Cl. ..... 473/334; 473/345; 473/338; 473/409

(58) Field of Search ..... 473/324, 334, 473/335, 336, 337, 338, 339, 345, 349, 290, 291, 297, 519, 409

(56) References Cited

U.S. PATENT DOCUMENTS

| | | | | | |
|---|---|---|---|---|---|
| 1,518,316 | A | | 12/1924 | Ellingham | |
| 2,225,930 | A | * | 12/1940 | Sexton | 473/338 |
| 3,064,980 | A | * | 11/1962 | Steiner | 473/335 |
| 3,466,047 | A | * | 9/1969 | Rodia et al. | 473/338 |
| 3,606,327 | A | * | 9/1971 | Gorman | 473/297 |
| 3,692,306 | A | | 9/1972 | Glover | |
| 4,052,075 | A | * | 10/1977 | Daly | 473/338 |
| 4,754,977 | A | | 7/1988 | Sahm | 273/171 |
| 4,795,159 | A | * | 1/1989 | Nagamoto | 473/338 |
| 4,869,507 | A | | 9/1989 | Sahm | 273/171 |
| 5,050,879 | A | | 9/1991 | Sun et al. | 273/80 A |
| 5,253,869 | A | | 10/1993 | Dingle et al. | 273/80.1 |
| 5,316,305 | A | * | 5/1994 | McCabe | 473/332 |
| 5,320,005 | A | | 6/1994 | Hsiao | |
| 5,385,348 | A | * | 1/1995 | Wargo | 473/338 |
| 5,421,577 | A | | 6/1995 | Kobayashi | |
| 5,571,053 | A | * | 11/1996 | Lane | 473/336 |
| 5,746,664 | A | * | 5/1998 | Reynolds, Jr. | 473/252 |
| 5,935,019 | A | | 8/1999 | Yamamoto | |
| 5,947,840 | A | | 9/1999 | Ryan | 473/335 |
| 5,967,905 | A | | 10/1999 | Nakahara et al. | |
| 6,056,649 | A | | 5/2000 | Imai | |
| 6,089,994 | A | * | 7/2000 | Sun | 473/338 |
| 6,379,265 | B1 | | 4/2002 | Hirakawa et al. | |
| 6,527,649 | B1 | | 3/2003 | Neher et al. | 473/248 |
| 6,641,487 | B1 | * | 11/2003 | Hamburger | 473/288 |
| 2002/0137576 | A1 | | 9/2002 | Dammen | 473/336 |

FOREIGN PATENT DOCUMENTS

| | | |
|---|---|---|
| JP | 10-234902 | 8/1998 |

* cited by examiner

*Primary Examiner*—Sebastiano Passaniti
(74) *Attorney, Agent, or Firm*—Sheppard, Mullin, Richter & Hampton L.L.P.

(57) ABSTRACT

The invention provides a golf club head having adjustable weight, allowing the golfer to fine tune the club for his or her swing. The club head includes a body having a ball-striking face, a sole, a crown, and a side extending rearwardly from the face. The body defines an interior cavity and a recess on a selected wall of the body spaced apart from the striking face. A threaded opening is disposed in the recess. The club head further includes a weight assembly having fastener and a mass element configured to be press-fit into the recess the such that a first end is adjacent the bottom of the recess. The mass element also has an aperture configured to receive the fastener flush. The fastener removably attaches the weighting assembly to the selected wall of the club head. Pressure from the fastener attachment provides a press-fit of the mass element in the tapered recess of the selected wall.

23 Claims, 4 Drawing Sheets

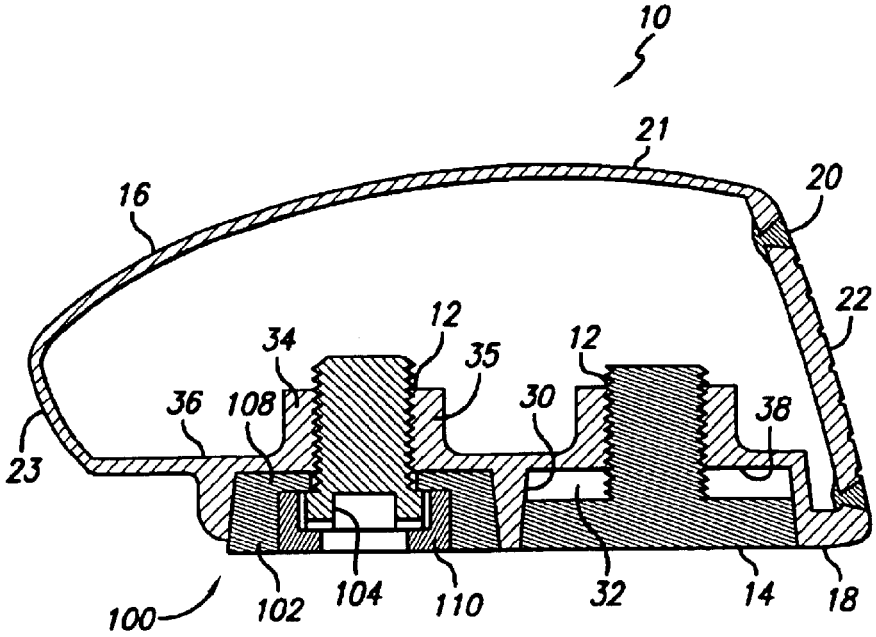
FIG. 1
FIG. 2a
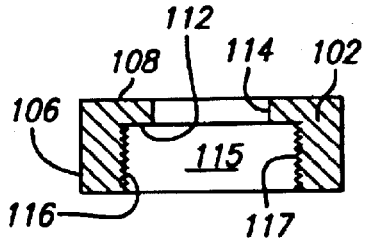
FIG. 2b
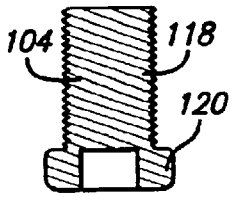
FIG. 2c
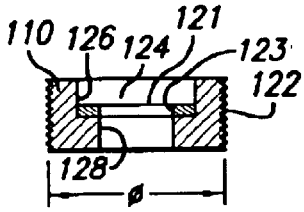
FIG. 2d
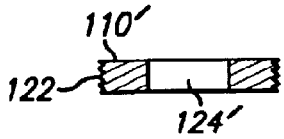

GOLF CLUB HEAD HAVING A REMOVABLE WEIGHT

FIELD OF THE INVENTION

The invention relates generally to a golf club head and, more particularly, to a wood-type golf club head having a volume of at least 150 cc.

BACKGROUND OF THE INVENTION

Current driver and fairway wood golf club heads are typically formed of steel or titanium alloys. For example, oversize driver heads exceeding 300 cc in volume are usually formed of a lightweight titanium alloy such as Ti 6A1-4V. Unless modified, oversize heads can have a relatively high center of gravity, which can adversely affect launch angle and flight trajectory of a golf ball. Thus, many club heads have integral sole weight pads cast into the head at a predetermined location to lower the club's center of gravity. Also, epoxy may be later added through the hosel to obtain a final desired weight of the club head. Alternatively, club heads may have weights, usually of a higher density material than the titanium or steel alloy, externally attached to the sole. The weights may be welded in place or attached using a fastener such as a screw. Because of the repeated contact with the ground during the golfer's swings, use of an adhesive alone is not advised as a long term, external attachment method for a weight.

These weights are of a prescribed amount and are attached prior to purchase. However, the club's weighting typically is set for a standard, or ideal, swing type. Thus, even though the weight may be too light or too heavy, or too far forward or too far rearward, the golfer cannot adjust or customize the club weighting to his or her particular swing.

It should, therefore, be appreciated that there is a need for a golf club head that allows a golfer to fine tune the weight of the club head for his or her swing. The present invention fulfills this need and others.

SUMMARY OF THE INVENTION

The invention provides a golf club head having adjustable weight, allowing the golfer to fine tune the club for his or her swing. The club head includes a body having a ball-striking face, a sole, a crown, and a side extending rearwardly from the face. The body defines an interior cavity and a recess on a selected wall of the body spaced apart from the striking face. A threaded opening is disposed in the recess. The club head further includes a weight assembly having fastener and a mass element configured to be press-fit into the recess the such that a first end is adjacent the bottom of the recess. The mass element also has an aperture configured to receive the fastener flush. The fastener removably attaches the weighting assembly to the bottom wall of the club head. Pressure from the fastener attachment provides a press-fit of the mass element in the recess. Thus, a golfer can try out a selected first weight on the club head and then change to a different second weight that may be more desirable in its mass and/or mass distribution properties.

In a preferred embodiment, the weight assembly further includes a retaining element configured to retain the fastener the aperture in the mass element and to receive the tip of a tool for tightening or loosening the fastener. The retaining element also serves to aid in removing the mass element when the fastener is loosened, as the head of the fastener presses against the retaining element in an outward direction while the retaining element is secured to the mass element. Preferably there is a low friction element positioned between the head of the fastener and the retaining element. The mass and retaining elements move in concert as the fastener is loosened from the selected wall.

In a detailed aspect of a preferred embodiment, the mass element may be configured in various shapes and densities. For example, the weight assembly can have a triangular shape and one side portion could be different in density. Thus, the weight assembly could move the center of gravity slightly forward, slightly to the toe and rear or slightly to the rear and heel, depending upon the arrangement of the heavier side portion. Other shapes of the weight assembly can be employed for different weighting schemes as well as for cosmetic effect.

In another detailed aspect of a preferred embodiment, the body defines a plurality of recesses for receiving a weight assembly. Optionally, a combination of a weight assemblies and plugs can be secured in the plurality of recesses.

For purposes of summarizing the invention and the advantages achieved over the prior art, certain advantages of the invention have been described herein above. Of course, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

BRIEF DESCRIPTION OF THE DRAWINGS

Embodiments of the present invention will now be described, by way of example only, with reference to the following drawings in which:

FIG. 1 is a cross-sectional view of a first preferred embodiment of a club head in accordance with the invention, showing two attachments to the sole of the club head.

FIG. 2*a* is a cross-sectional view of a mass element for the club head of FIG. 1.

FIG. 2*b* is a cross-sectional view of a screw to be received through the mass element of FIG. 2*a*.

FIG. 2*c* is a cross-sectional view of a retaining element for the club head of FIG. 1.

FIG. 2*d* is a cross-sectional view of an alternative retaining element for the club head of FIG. 1.

DETAILED DESCRIPTION OF THE PREFERRED EMBODIMENTS

Figure 3A:
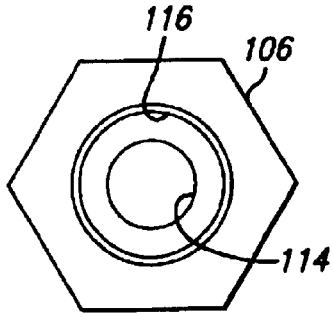
FIG. 3*a* is a plan view of the exposed end of the mass element of FIG. 2*a*.

Now with reference to the illustrative drawing, and particularly FIG. 1, there is shown a club head 10 having a main body and removable weight assembly 100 secured in one of a plurality of recesses 32. The weight assembly includes a mass element 102, a screw 104 and a retaining element 110. The recesses can interchangeable receive a weight assembly or a plug 14. The plug is preferably formed of a material having similar density of the main body. By having more than one recess, a golfer can fine tune the weighting of the club head by locating weight assemblies forward toward a front wall 20 or rearward away from the front wall.

Figure 4:
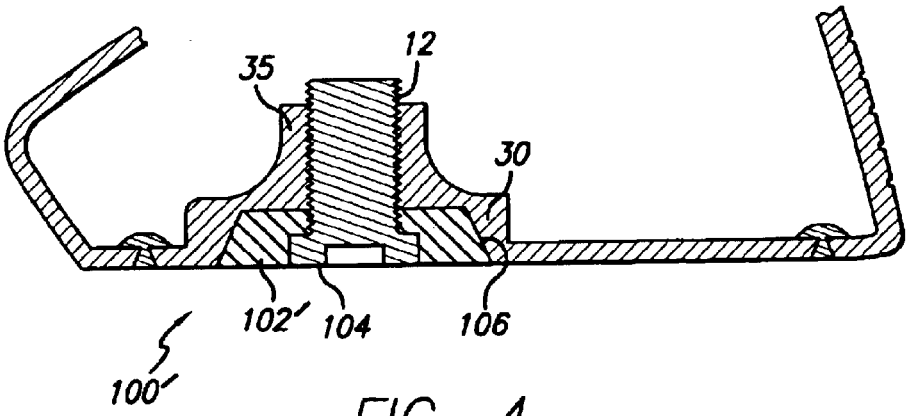
FIG. 4 is a partial cross-sectional view of a second preferred embodiment of a club head in accordance with the invention, depicting a single attachment to the sole.
Figure 6:
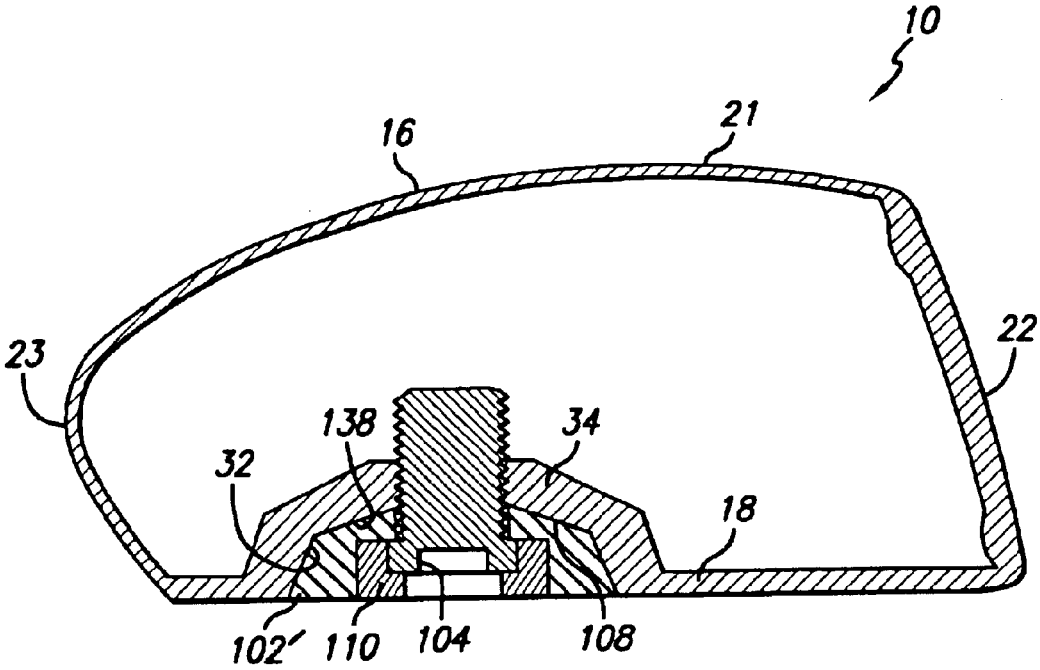
FIG. 6 is a sectional view of a third preferred embodiment of the present invention.

The main body 16 is formed of metal and a striking face 22 may be integrally formed or attached using methods known to those skilled in the art. A sole 18 may be integrally formed or separately formed then attached (FIG. 4). The recess 32 is defined by a recess wall 30 and a recess bottom 38. The recess bottom defines a threaded opening 12 for attachment of the weight assembly 100. As shown in FIGS. 1 and 4, the recess wall may be tapered and the threaded opening may be further defined by a boss 35 extending either inward (FIG. 1) or outward (FIG. 4) relative to the cavity. In this embodiment, the boss has a length at least half the length of the body of the screw and, more preferably, the boss has a length 1.5 times a diameter of the body of the screw. Alternatively, as shown in FIG. 6, the threaded opening may be formed without a boss.

With continued reference to FIG. 1, the recess 32 is defined on the sole 18 and the mass element 102 is secured in place using the screw 104. Another fastener such as a bolt may alternatively be used. The pressure from the engagement of the screw provides a press-fit of the mass element into the recess on the sole, as sides 106 of the mass element slide tightly against the recess side wall 30. A bottom end surface 108 of the mass element preferably contacts the recess bottom 38; however, retention of the weight assembly derives substantially from the press-fit. The retaining element 110 allows for easy removal of the mass element. This feature allows the club head to be modified by the golfer trying more than one weight element at the one or more locations on the sole. Upon determination of the final desired weighting of the sole, the weight is left securely attached to the club head for play. The recesses may also be located more toward a toe or a heel of the club head, as desired. In alternative embodiments, the one or more recesses may be provided on a top wall 21 or side wall 23 of the body 16 to allow weighting at that portion of the club head.

Figure 3B:
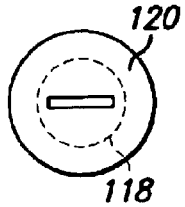
FIG. 3*b* is a top plan view of the screw of FIG. 2*b*.

Referring to FIGS. 2*a* and 3*a*, the mass element 102 has a hexagonal shape and defines an aperture 112 sized to freely receive the screw 104. As shown in FIG. 2*a*, the aperture has a first diameter at a first end 114 that is smaller than a second diameter at a recess 115 in a second end 116. The first diameter is sized to freely receive a body 118 (FIG. 2*b*) of the screw and the second diameter is sized and to receive the retaining element 110. The second end of the mass element having the second diameter has internal threads 117 for securing the retaining element over a head 120 of the screw (see FIG. 3*b*).

Figure 3C:
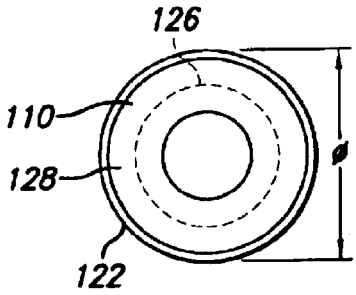
FIG. 3*c* is a plan view of the exposed end of the retaining element of FIG. 2*c*.

FIGS. 2*c* and 3*c* show the retaining element 110 having an outer diameter (>and an outer surface 122 that includes threads to mate with the internal threads 117 of the mass element. Preferably, the retaining element has an aperture 124 that has a first diameter at an inner end 126 that is greater than a second diameter at an outer end 128. The first diameter is sized to freely receive the head 120 of the screw. More preferably, a low-friction element 121 having low-friction surfaces is sized to be received in the aperture 124 at the inner end. The low-friction element has an aperture 123 having substantially the same diameter as the second diameter at the outer end 128 of the aperture.

With reference now to FIG. 2*d*, an alternative retaining element 110' may be provided having an aperture 124' with a single diameter. The low-friction element 121 may then have an outer diameter corresponding to the outer diameter of the retaining element. The apertures of the low-friction element and the retaining element are both sized to receive a tip end of a screwdriver (not shown) for tightening and/or loosening the screw. When assembled, the screw head 120 is between the mass element 102 and retaining element. For other fasteners, the apertures are preferably sized to receive the appropriate fastening tool. Also, instead of a separate low-friction element 121, appropriate surfaces of the retaining element adjacent to the screw head may be treated to obtain similar low friction characteristics so that outward rotation of the screw does not cause rotation of the retaining element.

With reference again to FIG. 1, the weight assembly 100 comprises a conventional screw and the material of the mass element has a density different from the density of the material of the main body 16. The retaining element 110 may comprise any material and is preferably a metal. As shown in FIG. 3*a*, as well as FIGS. 5*a*–5*c*, the mass element 102 may have any outer shape, such as triangular, oval or rectangular. After the desired weight is determined and confirmed by the golfer, adhesive may be applied to the screw threads to further secure the weight to the club head. Of course, heating or other methods known to those skilled in the art may be used to allow removal of the weight if adhesive has been applied.

For installation of the weight assembly 100 of FIG. 1, the screw head 120 is preferably placed into the inner opening 126 of the retaining element 110 and then the body 118 of the screw is placed through the aperture 112 of the mass element 102. The head 120 is trapped between the retaining element and the mass element as the retaining element is screwed into place. The threaded body 118 of the screw is screwed into the threaded opening 12. A screwdriver engages the head of the screw through the retaining element's aperture 124, and as the screw engages the threads of the interior wall of the main body, the weight assembly 100 achieves a press-fit against the tapered wall 30 of the recess 32. This embodiment also allows easier removal of the weight, if desired, since as the screwdriver turns the head of the screw it applies an outward force on the retaining element and thus helps push out the mass element.

Advantages of the present invention may be obtained without the use of the retaining element, as illustrated in a preferred embodiment of FIG. 4. In this embodiment the weight assembly 100' includes a mass element 102' and a screw 104. The engagement of the screw into the threaded opening 12 of the sole causes the sides 106 of the mass element to be compressed against the tapered walls 30 of the recess, achieving a secure press-fit.

With reference now to FIG. 6, another preferred embodiment of club head having a retaining element 110 with a mass element 102' and screw 104 is shown. A recess bottom 138 is configured to have a taper steeper than the side wall 30 of the recess. The mass element 102' may have a complementary end shape 108' to contact the bottom of the recess. Alternatively, the mass element may have a substantially planar end surface 108 that is tightly compressed against the tapered bottom surface of the recess as the screw is engaged.

Figure 5A:
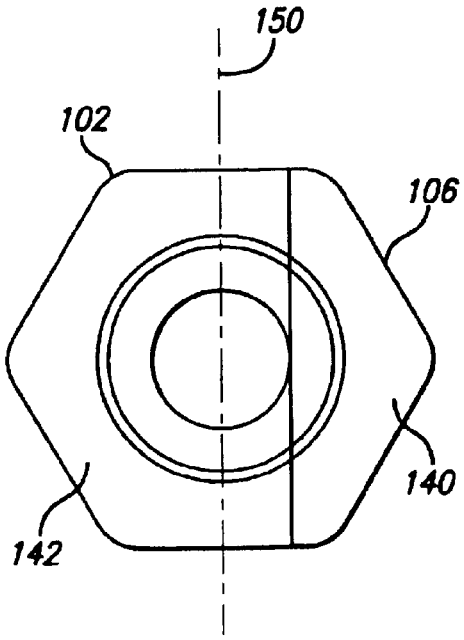
FIG. 5*a* is a plan view of the exposed end of an alternative mass element similar to FIG. 3*a*, depicting two different density regions within the mass element.
Figure 5B:
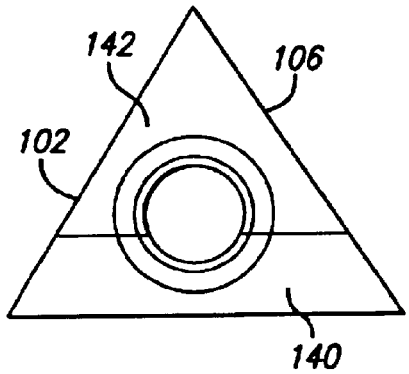
FIG. 5*b* is a plan view of the exposed end of another mass element, having a triangular shape and having a density that is different along one side from the remaining two sides.
Figure 5C:
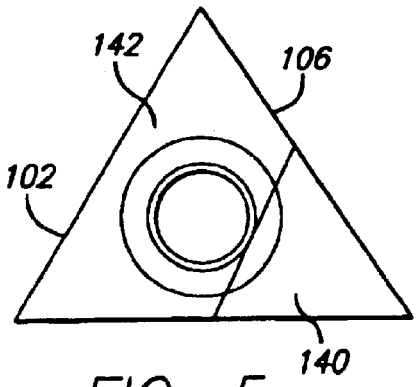
FIG. 5*c* is a plan view of the exposed end of yet another mass element similar to FIG. 5*b* and having a different density in one of the three corners.

With reference now to FIGS. 5*a*–5*c*, the mass element 102, 102' may have at least one axis of symmetry 150 and a region 140 that has a different density than a remaining region 142 of the element. Thus, the moment of inertia and center of gravity of the club head may be altered by altering the orientation of the mass element in the recess. For example, the different density region 140 may be aligned toward the front, toe, heel and/or rear direction of the club head. Examples are a hexagonal-shaped mass element with a higher density region 140 (FIG. 5*a*), a triangular-shaped mass element with a higher density side 140 (FIG. 5*b*), and a triangular-shaped mass element with a higher density corner 140 (FIG. 5*c*). The different densities may be achieved by methods known to those skilled in the art, such as using compression and sintering techniques, as in powder metallurgy, to achieve the desired density distribution in a metal product.

Figure 7:
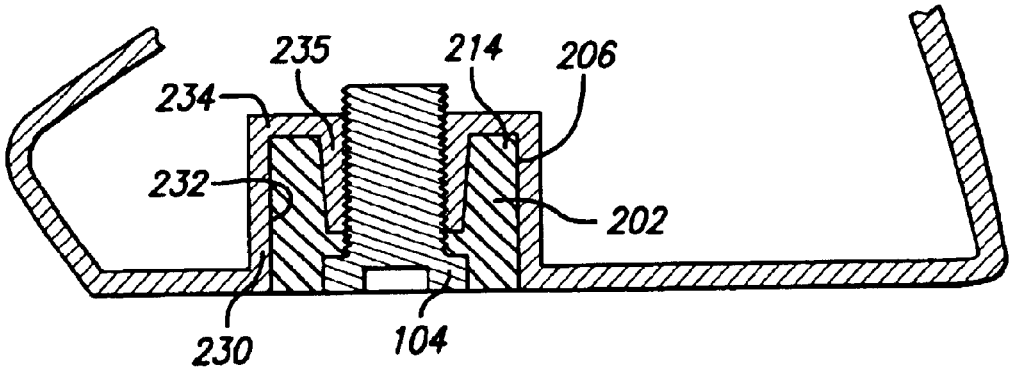
FIG. 7 is a partial sectional view of a fourth preferred embodiment of the present invention.

Yet another embodiment of the present invention is shown in the partial sectional view of FIG. 7. The recess 232 has substantially straight walls 230 formed toward the interior of the club head, and a boss 235 located in the recess. A wall 234 at the bottom of the recess that forms the boss is tapered outwardly. The mass element 202 has substantially straight, parallel walls, and the pressure by the fastener is focused on the inner walls of the element 102 to press-fit the weight assembly in the recess. It is understood that a retaining element, comprising a low friction surface, may be used with the mass element to form the easily removable weight assembly.

Although the invention has been disclosed in detail with reference only to the preferred embodiments, those skilled in the art will appreciate that additional golf club heads can be made without departing from the scope of the invention. Accordingly, the invention is defined only by the claims set forth below.

We claim:

1. A golf club head, comprising:

a body defining an interior cavity and including a ball-striking face, a sole, a crown, and a side extending rearwardly from the face; wherein, a selected wall of the body, excluding the striking face, has at least one recess comprising a tapered wall and a threaded opening; and a weight assembly having a fastener and a mass element configured to be press-fit into the recess of the body such that a first end of the mass element is adjacent a bottom of the recess, the mass element defining an aperture having a first diameter at the first end and a second diameter at a second end of the mass element, the first diameter greater than a diameter of a threaded body of the fastener and less than a diameter of a head of the fastener, the second diameter greater than the head of the fastener; wherein the fastener removably attaches the weight assembly in the recess, pressure from the threaded fastening accomplishing a press-fit of the mass element in the recess;

wherein the selected wall includes a boss extending from a bottom of the recess, wherein further the boss defines the threaded opening and has a length at least 1.5 times the diameter of the threaded body of the fastener.

2. A golf club head as defined in claim 1, wherein, the mass element is formed of a material having a different density than the density of a material of the selected wall.

3. A golf club head as defined in claim 1, wherein the mass element comprises a non-circular shape in cross-section.

4. A golf club head, comprising:

a body defining an interior cavity and including a ball-striking face, a sole, a crown, and a side extending rearwardly from the face; wherein a selected wall of the body, excluding the striking face, has at least one recess comprising a tapered wall and a threaded opening; and a weight assembly having a fastener and a mass element configured to be press-fit into the recess of the body such that a first end of the mass element is adjacent a bottom of the recess, the mass element defining an aperture having a first diameter at the first end and a second diameter at a second end, the first diameter greater than a diameter of a threaded body of the fastener and less than a diameter of a head of the fastener, the second diameter eater than the head of the fastener; wherein the fastener removably attaches the weight assembly in the recess, pressure from the threaded fastening accomplishing a press-fit of the mass element in the recess; wherein the selected wall is a bottom wall.

5. A golf club head as defined in claim 4, wherein the bottom of the recess is non-planar and the first end of the mass element has a shape conforming to the bottom of the recess.

6. A golf club head, comprising:

a body defining an interior cavity and including a ball-striking face. a sole, a crown, and a side extending rearwardly from the face; wherein a selected wall of the body, excluding the striking face, has at least one recess comprising a tapered wall and a threaded opening; and a weight assembly having a fastener and a mass element configured to be press-fit into the recess of the body such that a first end of the mass element is adjacent a bottom of the recess, the mass element defining an aperture haying a first diameter at the first end and a second diameter at a second end, the first diameter greater than a diameter of a threaded body of the fastener and less than a diameter of a head of the fastener, the second diameter greater than the head of the fastener; wherein the fastener removably attaches the weight assembly in the recess, pressure from the threaded fastening accomplishing a press-fit of the mass element in the recess; wherein the selected wall further comprises a second recess and a plug secured in the second recess, the plug formed of a material having a density no greater than the density of the material of the selected wall.

7. A golf club head comprising:

a body defining an interior cavity and including a ball-striking face, a sole, a crown, and a side extending rearwardly from the face; wherein a selected wall of the body, excluding the striking face, has at least one recess comprising a tapered wall and a threaded opening; and a weight assembly having a fastener and a mass element configured to be cress-fit into the recess of the body such that a first end of the mass element is adjacent a bottom of the recess, the mass element defining an aperture having a first diameter at the first end of the mass element and a second diameter at a second end of the mass element, the first diameter greater than a diameter of a threaded body of the fastener and less than a diameter of a head of the fastener, the second diameter greater than the head of the fastener; wherein the fastener removably attaches the weight assembly in the recess, pressure from the threaded fastening accomplishing a press-fit of the mass element in the recess; and a retaining element configured to retain the fastener in the aperture in the mass element.

8. A golf club head as defined in claim 7, wherein the selected wall further comprises a second recess, a second weight assembly secured in the second recess.

9. A golf club head as defined in claim 7, wherein the retaining element is formed of a material having a different density than the density of a material of the selected wall.

10. A golf club head as defined in claim 7, wherein the retaining element comprises a low friction element.

11. A golf club head as defined in claim 7, wherein the retaining element has an aperture sized to receive a tool used to turn the head of the fastener.

12. A golf club head as defined in claim 7, wherein the retaining element has an aperture with a first diameter sized to freely receive a tip of a tool and a second diameter sized to freely receive the head of the fastener.

13. A method of removably attaching a weight to a golf club head, comprising:

providing a golf club head having a top wall, a front wall, a side wall extending rearwardly of the front wall from a toe end to a heel end of the club head and a bottom wall, a selected one of the top, side and bottom walls having at least one recess comprising a tapered wall and a threaded opening;

providing a weight assembly having a mass element and a fastener, the mass element having an aperture configured to allow a threaded body of the fastener to extend out the lower end of the mass element to engage the threaded opening and to inhibit a head of the fastener from passing entirely through the aperture, the mass element formed of a material having a density different than the density of the material of the selected wall;

inserting the threaded body of the fastener through the aperture of the mass element;

providing a retaining element positioned atop the fastener; and engaging the fastener into the threaded opening in the recess of the selected wall of the club head, the pressure from the engagement of the fastener accomplishing a press-fit of the mass element in the recess of the selected wall.

14. A method as defined in claim 13, further comprising the step of providing a low friction element between the head of the fastener and the retaining element.

15. A method as defined in claim 13, further comprising the step of threadably engaging the retaining element in the aperture of the mass element, the retaining element having an aperture sized to receive a tip of a tool used to turn a head of the fastener.

16. A method as defined in claim 13, wherein the step of inserting the fastener through the aperture of the mass element is performed prior to the step of engaging the retaining element in the aperture.

17. A method as defined in claim 13, wherein the recess in the selected wall of the club head is non-circular in cross-section and the step of providing a weight assembly comprises providing a mass element of a shape complementary to the recess.

18. A method of removing a weight from a wall of a hollow golf club head, comprising the steps of:

providing a golf club head having a top wall, a front wall, a side wall extending rearwardly of the front wall from a toe end to a heel end of the club head and a bottom wall, a selected one of the top, side and bottom walls having at least one recess comprising a tapered surface and a threaded opening;

providing a weight assembly in the recess of the selected wall, the weight assembly having a mass element, a retaining element and a fastener, the mass element formed of a material having a density different than the density of the material of the selected wall, the retaining element threadably attached to the mass element, the fastener extending through an aperture of the mass element and through the threaded opening of the recess;

inserting a tool through an aperture of the retaining element to engage a head of the fastener; and rotating the tool to remove the fastener from the threaded opening of the recess;

wherein the head of the fastener contacts a portion of the retaining element, the outward force applied to the retaining element by the fastener being transmitted to the mass element thus removing the weight assembly from the tapered recess of the golf club head.

19. A method as defined in claim 18, wherein the weight assembly is provided in the bottom wall of the golf club head.

20. A golf club head, comprising:

a body having a top wall, a front wall, a side wall, and a bottom wall, a selected one of the top, side and bottom walls defining a recess, the club head defining a threaded opening in a wall of the recess; and a weight assembly having a fastener having a head and a threaded body extending from the head, the threaded body configured to cooperatively engage the threaded opening of the club head, a mass element disposed about the fastener and having an upper end and a lower end, the lower end being adjacent to the threaded opening, the mass element defining a bore configured to allow the threaded body of the fastener to extend out the lower end of the mass element to engage the threaded opening, and a retaining element attached to the mass element such that the head of the fastener is in captured relationship to both the retaining element and the mass element, the retaining element defining an aperture aligned with the head of the fastener; wherein the head of the fastener is inhibited from passing entirely through the bore.

21. A golf club head as defined in claim 20, wherein the mass element comprises a non-circular shape in cross-section and the recess is defined with a shape conforming to that of the mass element such that pressure from the engagement of the fastener accomplishes a press-fit of the mass element in the recess.

22. A golf club head as defined in claim 20, wherein the bore of the mass element includes a lower portion and an upper portion, the lower portion is sufficiently sized to freely receive the body of the fastener while not allowing the head of fastener to pass, the upper portion is sufficiently sized to allow the head of the fastener to rest therein.

23. A golf club head as defined in claim 22, wherein the upper portion of the bore and the retaining element are configured to threadably mate with each other such that the head of the fastener is in a captured relationship to both the mass element and the retaining element.

* * * * *